United States Patent [19]

Braun

[11] 4,332,196

[45] Jun. 1, 1982

[54] PRESSURIZED ARRANGEMENT INCLUDING TIMERS FOR METERING INK ON THE FOUNTAIN ROLLER OF A PRINTING PRESS

[75] Inventor: Rolf Braun, Offenbach am Main, Fed. Rep. of Germany

[73] Assignee: M.A.N.-Roland Druckmaschinen Aktiengesellschaft, Fed. Rep. of Germany

[21] Appl. No.: 236,146

[22] Filed: Feb. 20, 1981

Related U.S. Application Data

[63] Continuation-in-part of Ser. No. 213,865, Dec. 8, 1980, abandoned.

[30] Foreign Application Priority Data

Dec. 21, 1979 [DE] Fed. Rep. of Germany ..... 2951651

[51] Int. Cl.[3] ..... B41F 31/08; B41L 27/10

[52] U.S. Cl. ..... 101/365; 101/DIG. 26

[58] Field of Search ..... 101/365, 363, 364, 366, 101/349, 350, 148, 147, 206, 207, 208, 210, DIG. 26; 118/259, 410

[56] References Cited

U.S. PATENT DOCUMENTS

| | | | |
|---|---|---|---|
| 1,185,667 | 6/1916 | Hoe | 101/363 |
| 3,134,326 | 5/1964 | Davis | 101/366 |
| 3,926,114 | 12/1975 | Matuschke | 101/350 X |
| 4,041,864 | 8/1977 | Dahlgren et al. | 101/350 |

FOREIGN PATENT DOCUMENTS

| | | | |
|---|---|---|---|
| 869690 | 2/1942 | France | 101/365 |

*Primary Examiner*—J. Reed Fisher

*Attorney, Agent, or Firm*—Leydig, Voit, Osann, Mayer & Holt, Ltd.

[57] ABSTRACT

An ink fountain of the type in which ink is metered from nozzles located in respective zonal positions. The nozzles have narrow axially extending openings in general alignment with one another closely side by side. A tank is provided adjacent the fountain roller, with the nozzles being in the form of slots at the bottom of the tank, the tank being sealed and connected to a source of viscous ink under predetermined pressure. Reciprocable slides are arranged side by side interposed between the nozzles and the surface of the fountain roller, each slide having a reference position for normally blocking off ink flow from the associated nozzle and being retractable to open the nozzle. A solenoid is connected to each of the slides for forcibly and temporarily retracting the slide from its reference blocking position. Each solenoid has a biasing spring for restoring the slide to its reference blocking position. An individually adjustable timing device is controllingly connected to each solenoid for cyclically energizing it for pre-set intervals of time which correspond to the ink requirement in the respective zonal position. The tank in the preferred embodiment is supplied with ink through a supply line fed by a pump from an open reservoir.

9 Claims, 4 Drawing Figures

PRESSURIZED ARRANGEMENT INCLUDING TIMERS FOR METERING INK ON THE FOUNTAIN ROLLER OF A PRINTING PRESS

This is a continuation-in-part of application Ser. No. 213,865 filed Dec. 8, 1980, now abandoned.

It is a well known fact that the ink requirements across the width of a printed page is not the same column by column or zone by zone. In some of the column positions there may be heavily pigmented areas as, for example, a half-tone illustration with a dark background, requiring more ink to be fed in that position than in other positions across the page which are only lightly pigmented.

In lieu of using an adjustable fountain blade for localized control of rate of feed, it has been known for many years that ink may be metered through nozzles in respective zonal positions to satisfy the ink requirements in the zonal position. For example in German document DE-GM No. 1 943 939 there is disclosed a series of nozzles spaced from the surface of the fountain roller, the nozzles being supplied from a pump with the rate of delivery to the nozzles being variable for metering purposes. Such arrangement is found to have the disadvantage that the ink metering is inaccurate and difficult to control particularly in the face of variations in the operating conditions, for example, the viscosity of the ink.

It is, accordingly, an object of the present invention to provide an ink metering arrangement for a printing press in which localized adjustment in pressure or in the rate of delivery of the ink to the nozzles is not relied upon to vary the ink fed in each position but in which the pressure of the ink is maintained substantially constant, with the average ink flow in each position being controlled by turning the nozzles on and off in accordance with a timed cycle in which the length of the "on" time is in accordance with the ink requirement at the particular zonal position.

It is a general object of the present invention to provide a zonal metering arrangement for a printing press employing "on"-"off" controllable nozzles which meter the ink accurately and with a high degree of reproducibility in accordance with the ink requirement in each position.

It is another object of the present invention to provide an accurate metering arrangement adjustable on a zonal basis which is more reliable than previous metering devices and which at the same time can be constructed with a high degree of economy for maintenance-free operation over long periods of time.

Other objects and advantages of the invention will become apparent upon reading the attached detailed description and upon reference to the drawings in which.

FIG. *2a* is a fragment showing a slide retracted from its associated nozzle for depositing of ink on the fountain roller.

Figure 3:
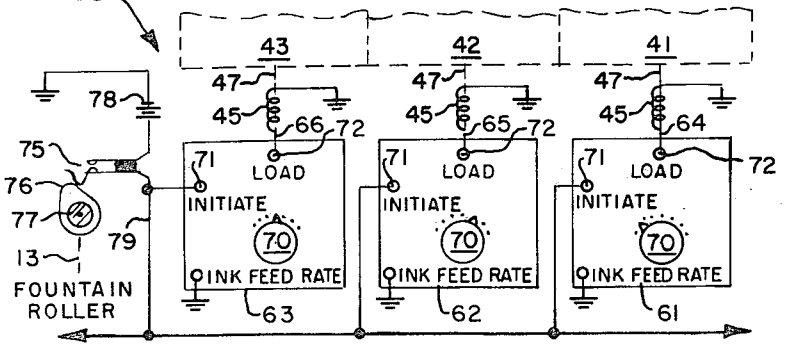

FIG. 3 shows use of adjustable timers for energizing the respective solenoids.

While the invention has been described in connection with certain preferred embodiments it will be understood that I do not intend to limit the invention to such embodiments but intend, on the contrary, to cover the various alternative and equivalent forms of the invention included within the spirit and scope of the appended claims.

Figure 2:
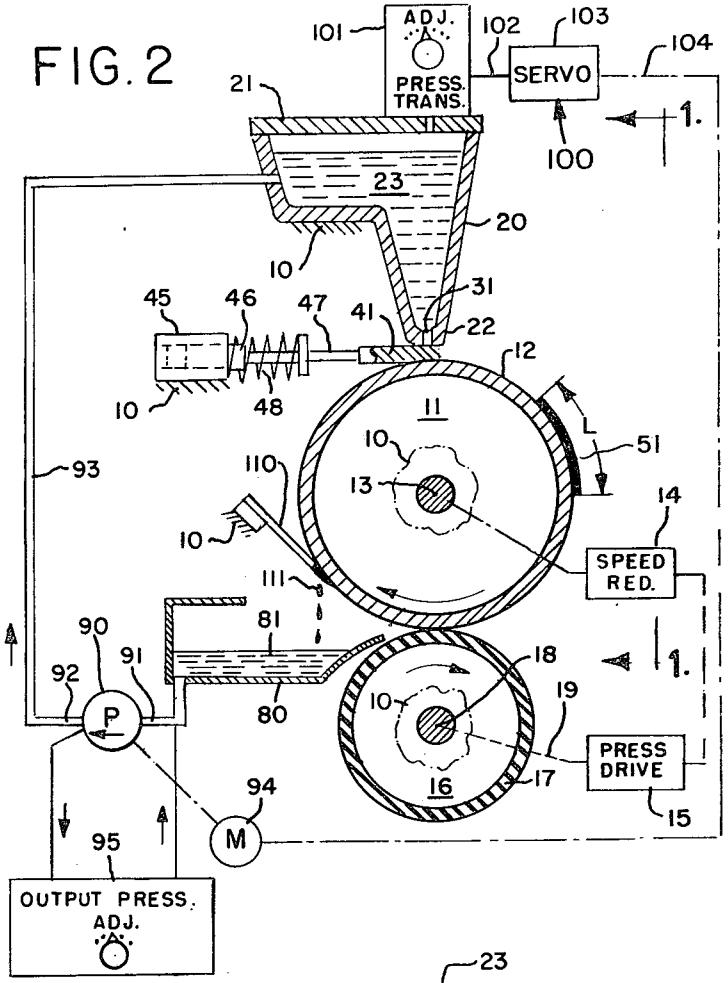
FIG. 2 shows my ink feeding arrangement in connection with a diagrammatic cross section, in elevation, looking along line 2—2 in FIG. 1.
Figure 1:
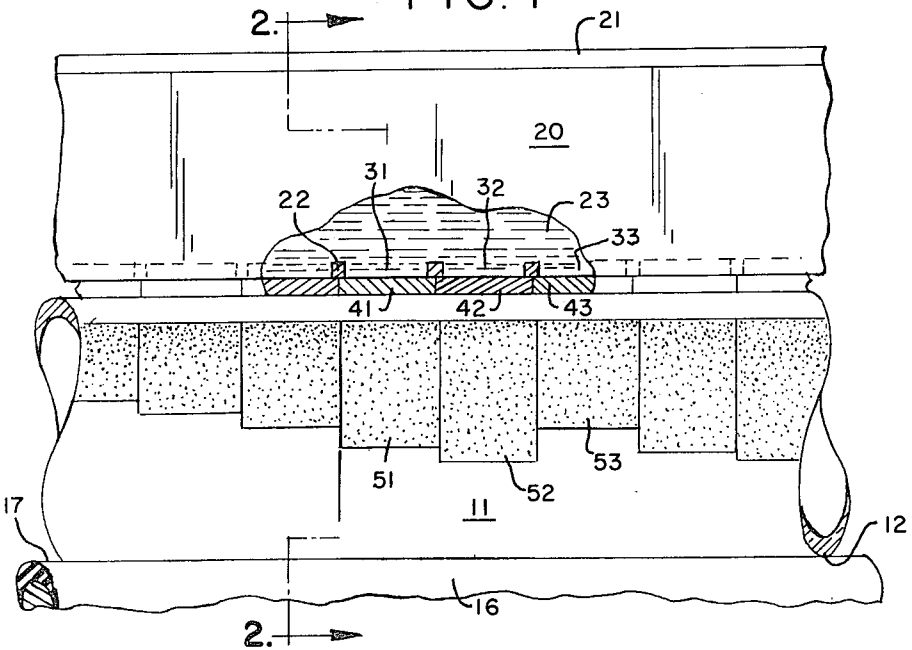
FIG. 1 is a fragmentary elevational view showing my ink fountain as viewed along line 1—1 in FIG. 2.

Turning now to FIGS. 1 and 2 of the drawings there is disclosed a fountain having a frame 10. Extending the length of the frame is a fountain roller 11 having a hard surface 12 and rotatable by a shaft 13. The shaft is driven at a relatively slow speed in the direction of the arrow by a speed reducing connection 14 driven from the press drive 15.

For the purpose of receiving ink from the fountain roller for transfer by a set of rollers (not shown) to the plate on the plate cylinder, the fountain roller is engaged by an acceptor roller 16 having a resilient covering 17 and rotated by a shaft 18 which is connected to the press drive by means of a drive connection 19.

The acceptor roller 16 is driven in a direction in which its surface moves oppositely to the direction of movement of the engaged surface of the fountain roller for removal of the ink on the latter by wiping action.

For the purpose of feeding ink to the surface of the fountain roller a plurality of nozzles are provided having narrow axially extending openings and arranged in general alignment with one another closely side by side to define respective zonal positions, each nozzle being connected to a source of viscous ink under predetermined pressure. More specifically in accordance with the invention the nozzles are in the form of a continuous row of slots formed in the bottom of a tank filled with viscous ink and which extends the length of the fountain roller. The tank is sealed and the ink is maintained under such constant pressure that it is forced out of each nozzle, when it is open, at a constant rate of flow.

Thus I provide a tank 20 which is superimposed above the fountain roller and which has a top 21 and a bottom 22. Contained within the tank, under predetermined pressure, is a body of ink 23. In alignment with one another at the bottom of the tank are a series of nozzles in the form of slots having the same cross sectional shape. Three of these nozzles, or slots, taken as representative, have been indicated (FIG. 1) at 31, 32 and 33.

In carrying out the invention reciprocable slides are provided arranged closely side by side and respectively interposed between the nozzle and the surface of the fountain roller, each slide having a reference position for normally blocking off ink flow from the associated nozzle but being retractable transaxially to open the nozzle for depositing of ink on the surface of the fountain roller. Three of the slides have been taken as representative and identified as 41, 42 and 43 positioned for respective blocking of the nozzles 31, 32 and 33. Thus the slide 41 is shown in FIG. 2 as being in blocking relation to nozzle 31, being sandwiched between the bottom of the tank and the surface 12 of the fountain roller.

For the purpose of forcibly and temporarily retracting the slide from its reference blocking position, an individual power actuator in the form of a solenoid 45 is provided. Such solenoid has an armature 46 which is connected to the slide by a plunger 47. The plunger has a biasing spring 48 for restoring the slide 41 to its reference blocking position when the solenoid is de-energized. Thus when all of the solenoids, connected to the respective slides, are deenergized, no ink flows to the fountain roller.

Figure 2A:
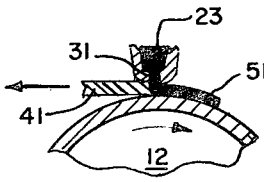

The effect of retracting a slide, for example the slide 41, from its blocking position is illustrated in FIG. 2*a*. Here it is shown that the body of ink 23, being pressurized, flows from the nozzle 31 in the manner of paste from a tube forming a strip 51 on the rotating surface 12 of the fountain roller. Such flow does not take place continuously but only for a short and predetermined time interval to produce an ink strip having a length L which contains a predetermined amount of ink and which, upon removal by the acceptor roller 16, is passed through a series of transfer rollers to satisfy the need for ink in the given column position. The adjacent strips of ink taken as representative, and which are indicated at 52, 53 are of the same thickness and the same width as the strip 51 but are of different lengths, the length corresponding to that required to satisfy the ink requirement in the respective column, or zonal, position.

In accordance with one of the important aspects of the present invention an individually adjustable control device is associated with each solenoid to cyclically energize the solenoid for pre-set intervals of time which correspond to the ink requirements in the respective zonal position. While the control means may take many different forms without departing from the present invention, a typical and simplified control arrangement has been illustrated at 60 in FIG. 3. The control arrangement for controlling the "on" times of typical slides 41, 42 and 43 includes a set of three timers 61, 62 and 63 having output lines 64, 65 and 66, respectively. Each timer is of the type having an "initiate" terminal which, upon being pulsed, energizes the load circuit and maintains the load turned on over the desired, adjustable time interval. When the timer "times out" the load is turned off and remains off until another "initiate" pulse is received at the beginning of the next cycle.

Thus, taking the timer 61 as representative, it includes a time adjusting knob 70, an "initiate" terminal 71 and a load terminal 72. In the particular arrangement illustrated in FIG. 3 the timers are initiated in parallel and means are provided for simultaneously pulsing them thereby defining the beginning of each cycle. This is conveniently done by a switch 75 (FIG. 3) which is closed momentarily by a cam 76 on a timing shaft 77 which is coupled to the shaft 13 of the fountain roller. A source of current 78 is included in the initiating circuit so that, when the switch 75 is closed, a pulse is applied to a line 79 which is connected to the "initiate" terminals 71 of all of the timers.

In accordance with one of the aspects of the present invention the ink tank 20 is maintained filled with ink under predetermined pressure via a tank supply line which extends from a reservoir to the tank, with an ink pump of the type producing a constant output pressure being interposed in the line. The ink reservoir, indicated at 80, is preferably open to the atmosphere, contains a body of ink 81. Ink is drawn from the reservoir by a pump 90 having a suction side 91 and a pressure side 92, the pressure side being connected to a supply line 93 leading to the sealed tank 20. The pump 90 is driven by a motor 94. The pump is preferably of the type, commercially available, in which the output pressure is limited to a predetermined and constant level. A typical pump meeting this requirement is one having a relief or dumping valve at the outlet settable by means 95 to divert fluid (ink) from the output line whenever the pressure in such line exceeds a predetermined level, the excess fluid, in effect, being re-circulated back to the source through a connection diagrammatically indicated at 96.

Other means may be employed for maintaining constant pressure of the ink in the tank 20 without departing from the invention. For example a servo system 100 may be employed having a pressure transducer 101 which produces an output signal at 102 which varies in accordance with the pressure, the output signal serving to control a servo device 103 having an output line 104 which energizes the drive motor 94. The operation of such type of servo system is well understood in the art, employing a pump which is preferably of the positive displacement type. As long as the pressure in the tank 20 is at the desired level, the motor does not rotate and no ink is pumped into the tank. However, should the pressure in the tank drop, the drop is sensed by the pressure transducer which energizes the servo device 103 so that an output signal exists on line 104 causing the motor to rotate the pump so that the inflow of ink into the tank causes the pressure in the tank to be at the desired level, and when such level is reached the action stops.

In accordance with one of the aspects of the present invention a doctor blade is provided on the fountain roller extending the length thereof and located downstream from the acceptor roller for removing any residual ink, that is, for removing ink which is not picked up by the acceptor roller. Thus I provide a doctor blade 110 having an edge which bears at an angle against the surface 12 of the fountain roller. The reservoir 80 is preferably located directly under the doctor blade, as illustrated in FIG. 2, for catching the removed ink 111 for re-circulation thereof to the tank 20.

Using the arrangement described above, two modes of wiping action are possible. In the first mode the rollers 11, 16 are adjusted so that the surface of the roller 11 indents the resilient covering 17 of the acceptor roller. With the acceptor roller operating at a speed which is substantially greater than the surface speed of the fountain roller, the fountain roller is wiped clear of ink, and with efficient transfer of the ink from the acceptor, a minimum of ink is returned to the surface of the fountain roller. However, where the two rollers are not in indented relation or where the transfer from the acceptor is less efficient, the percentage of residual ink may be substantially greater. In any event the doctor blade 110 insures that the surface of the fountain roller is constantly restored to its original clean condition for depositing thereon of fresh strips of ink during each cycle of operation.

The operation of the system just described will be apparent. Since all of the nozzles have the same cross sectional geometry and are subject to the same pressure, namely, the constant pressure existing in the tank 20, the amount of ink discharged during each rotational cycle of the fountain roller is dependent upon a single factor, the amount of time that the nozzle is open. In considering a typical cycle it will be assumed that pressure in the tank 20 is at rated level. It will further be assumed that the adjusting knobs 70 of the timers associated with the individual slides are all set for time intervals which correspond to the ink requirement in the particular zonal position. It will, finally, be assumed that the cam controlled switch 75 is in the phase position illustrated in FIG. 3. A moment thereafter the switch 75 momentarily closes applying, via line 79, an "initiate" pulse to all of the terminals 71 of the various timers. This immediately energizes all of the solenoids 45 so that ink flows in a strip in all of the column positions. However, as soon as each timer "times out", the associated solenoid is de-energized cutting off further flow of ink in the particular column or zonal position.

Where a pump 90 is employed having a relief valve, the pressure in the line 93 and in the tank 20 is automatically maintained at the level for which the relief valve has been set. Alternatively, where a servo system is employed to control the operation of the motor 94, any drop in pressure from the desired level is sensed by the transducer 101, energizing the servo 103 which produces an output signal to drive the motor 94 so that the pump rotates to restore the pressure to the desired level, following which the servo turns the pump off. The effect in the case of either of the two pump control systems is to maintain the pressure in the tank within a narrow band regardless of the total rate of withdrawal of ink. The pressure control point is adjustable (at 95, 101) making it possible to compensate for the viscosity of the ink being used.

The invention has been described in connection with use of a solenoid as a power actuator for individual shifting of the slides. It will be understood that the term "solenoid" is intended as a general term to include not only the form of actuator which has been illustrated but equivalents thereof, indeed any transducer which converts an electrical signal into motion in the desired direction. Also in the present instance the solenoid has been employed for retraction with an associated biasing spring for restoring the slide to its enclosing condition. It will be understood that this relation may be reversed without departing from the invention so that the term "energized" as used herein has a general meaning, although such a reversed system would have questionable practicality. Similarly the term "spring" as used herein is intended to refer to any source of bias.

While it is preferred to provide nozzles e.g. 31-33, in the form of narrow axially extending, but discontinuous, slots, the invention also contemplates the possibility that all of the nozzles may be formed as one long continuous slot although this, too, would be of questionable practicality in view of the pressure existing within the tank.

It will be apparent to one skilled in the art that the objects of the invention have been amply carried out. Since all of the nozzles have the same cross sectional geometry and are subjected to the same prressure, each nozzle produces the same instantaneous rate of discharge of ink. However, the average rate of discharge which depends upon the time factor may be easily and conveniently varied over wide limits by a simple manual adjustment of time interval. While it is true that a separate timer is required for each of the numerous slides across a page width, timers employing solid state devices and susceptible to accurate calibration may be very cheaply obtained on a commercial basis and may be expected to last indefinitely so that the overall cost of the presently disclosed control system is much lower than comparable systems in the prior art.

The arrangement is largely immune to minor unintended changes in pressure in the tank since a pressure change has substantially the same effect upon the instantaneous rate of discharge in all of the nozzles, leaving the ratio of the amounts of ink in the separate strips, which is a function of time only, virtually unchanged.

While the invention has been described above without reference to specific dimensions, it is preferred in practicing the invention to employ slides which are snugly fitted between the nozzles and the surface of the fountain roller and which are of constant thickness, a thickness which lies within the range of 0.05 to 0.2 mm. It is preferred that the stroke of each solenoid be such as to retract the associated blade to a point where the tip of the blade is flush with the rear wall of the slot, as illustrated in FIG. 2*a*, the slot thickness in the peripheral direction being on the order of 1 mm. to 5 mm. The pressure maintained in the tank should preferably be such as to force out of the nozzle a full thickness of ink as determined by the slide thickness and at a rate determined by the peripheral velocity of the fountain roller. Selection of pressure is a matter within the skill of the art and obviously depends upon the viscosity of the ink being acted upon. For example a pressure may be used within the range of 100 kPa (kilopascal) to 500 kPa above atmospheric in accordance with viscosity.

I claim:

1. An ink fountain comprising, in combination, a frame, a fountain roller journaled with respect to the frame and extending the length thereof, drive means for slowly rotating the fountain roller, an acceptor roller in engagement with the fountain roller, a plurality of nozzles having narrow axially extending openings and arranged in general alignment with one another closely side by side to define respective zonal positions, each nozzle being connected to a source of viscous ink under predetermined pressure, reciprocable slides arranged side by side respectively interposed between the nozzles and the surface of the fountain roller, each slide having a reference position for normally blocking off ink flow from the associated nozzle and being retractable transaxially therefrom to open the nozzle for depositing of ink on the surface of the fountain roller, means including an individual power actuator interposed between each slide and the frame for forcibly and temporarily retracting the slide from its reference blocking position as long as the power actuator is energized, each power actuator having a biasing spring for restoring the slide to its reference blocking position when the power actuator is de-energized, and an individually adjustable control device associated with each actuator for cyclically activating such actuator for pre-set intervals of time which correspond to the ink requirement in the respective zonal position.

2. The combination as claimed in claim 1 in which the source of viscous ink is in the form of a sealed tank adjacent the nozzles and in direct communication with each of them with means for exerting predetermined pressure upon the ink in the tank, the nozzles having substantially the same flow cross section so that the rate of discharge at each nozzle when it is in the open condition is the same.

3. The combination as claimed in claim 1 in which the nozzles are oriented to feed ink downwardly onto the fountain roller and in which the ink source is in the form of a sealed tank of ink spanning all of the nozzles, the nozzles being in the form of a continuous row of slots formed in the wall of the tank and with means including a pump for keeping the ink in the tank under predetermined pressure to provide a predetermined rate of discharge of ink in each zonal position when the nozzle in the zonal position is opened.

4. The combination as claimed in claim 1 in which the individual power actuators are in the form of solenoids and in which the adjustable control devices are in the form of timers each having an output line connected to an associated solenoid and with means for cyclically energizing the output line over a predetermined but adjustable time interval.

5. The combination as claimed in claim 1 in which the ink storage tank is sealed, an open ink reservoir, a tank supply line extending from the reservoir to the tank, an ink pump interposed in the supply line for replenishing the tank, means for controlling the output of the pump thereby to maintain a substantially constant pressure in the tank, a doctor blade on the fountain roller located downstream from the acceptor roller for removing residual ink.

6. The combination as claimed in claim 1 in which the ink storage tank is sealed, an open ink reservoir, a tank supply line extending from the reservoir to the tank, an ink pump interposed in the supply line for replenishing the tank, means for controlling the output of the pump thereby to maintain a substantially constant pressure in the tank, a doctor blade on the fountain roller located downstream from the acceptor roller for removing residual ink, the open ink reservoir being located directly under the doctor blade and extending the length thereof for catching the removed ink for recirculation thereof to the tank.

7. The combination as claimed in claim 1 in which the acceptor roller is resiliently surfaced and driven in a direction in which its surface moves oppositely to the direction of movement of the engaged surface of the fountain roller for wiping removal of the ink deposited by the nozzles.

8. An ink fountain comprising, in combination, a frame, a fountain roller journaled with respect to the frame and extending the length thereof, drive means for slowly rotating the fountain roller, an acceptor roller in engagement with the fountain roller, a sealed tank of viscous ink, nozzles in the wall of the tank in the form of narrow axially extending slots arranged in general alignment with one another and defining a uniform clearance space with respect to the surface of the fountain roller, reciprocable slides arranged side by side respectively interposed between the nozzles and the surface of the fountain roller, each slide having a reference position for normally blocking off ink flow from the associated nozzle and being retractable transaxially therefrom to open the nozzle for depositing of ink on the surface of the fountain roller, a solenoid interposed between each slide and the frame for temporarily retracting the slide from its reference blocking position as long as the solenoid is energized, a solenoid having a biasing spring for restoring the slide to its reference blocking position when the solenoid is de-energized, a timer for controlling the energization of each solenoid, means for cyclically initiating the operation of the timers, each of the timers having a manual adjustment for adjusting the time interval during which the associated solenoid is energized thereby to determine the average rate of feed of ink in the respective zonal position, means located on the fountain roller at a position downstream from the region of engagement of the acceptor roller for wiping from the fountain roller any residual ink remaining thereon, and means for replenishing the tank and for maintaining a substantially constant pressure above atmospheric therein.

9. The combination as claimed in claim 1 or in claim 8 in which the slides are snugly fitted between the nozzles and the surface of the fountain roller and in which the slides have a thickness within the range of 0.05 mm. and 0.2 mm.

* * * * *